United States Patent [19]

Haber

[11] Patent Number: 5,065,655

[45] Date of Patent: Nov. 19, 1991

[54] PILL STRIP DISPENSER

[76] Inventor: Terry M. Haber, 25011 Castlewood, El Toro, Calif. 92630

[21] Appl. No.: 491,672

[22] Filed: Mar. 9, 1990

[51] Int. Cl.[5] ..... B26D 1/56; B26F 1/00

[52] U.S. Cl. ..... 83/322; 83/425.2; 83/423; 83/678

[58] Field of Search ..... 83/660, 322, 678, 321, 83/331, 425.2, 423, 308; 221/30, 31, 32, 71, 72; 226/152, 156, 157, 127, 128; 70/133, 71

[56] References Cited

U.S. PATENT DOCUMENTS 3,367,535 2/1968 Tanguay ..... 221/71

3,420,421 1/1969 Hellberg ..... 225/96

*Primary Examiner*—Douglas D. Watts

*Assistant Examiner*—Allan M. Schrock

*Attorney, Agent, or Firm*—Townsend and Townsend

[57] ABSTRACT

A pill strip dispenser (4) is used with a pill strip (6) having a series of pill-containing packets (8) so the pills (10) can be dispensed individually. The dispenser includes a housing (14) defining a supply region (18) within which the pill strip is housed. The pill strip extends from the supply region along a dispensing path within the housing to a discharge position (12) next to but external of the housing. The packets are dispensed one at a time by a manually actuated drive assembly (46) including a user operated plunger (80). The pill strip is captured between a pair of toothed drive wheels (48), positioned at each lateral edge (36, 38) of the pill strip, and overlying resilient rollers (50). The tooth drive wheels not only drive the pill strip, but also perforate the pill strip packets so that the contents of the dispensed packet can be easily accessed. A pair of pill guides (70) are used along the dispensing path to push the pill within the pocket towards the center of the packet and away from the drive wheels.

30 Claims, 4 Drawing Sheets

PILL STRIP DISPENSER

BACKGROUND OF THE INVENTION

Hospitals often receive medicine in bulk containers for sake of economy. This medicine is often repackaged in various ways according to particular medicine involved and the requirements of the patient.

One conventional system packages the medicine in a pill strip. A machine for making these pill strips is made by Sanyo Corporation of Japan and is sold in the United States under the trademark ATC 212. The pill strip is essentially a length of plastic folded over and sealed to create a series of individual pill packets. One advantage of this system is that the individual pill packets can be uniquely identified as to contents, patient, mode and time of administration of the medicine. However, the storage and dispensing of these pill strips has remained a problem.

SUMMARY OF THE INVENTION

The present invention is directed to a pill strip dispenser which permits a pill strip to be neatly housed within the dispenser and conveniently dispensed, typically one packet at a time, while perforating or otherwise weakening the packet to permit easy access to the medicine inside.

The pill strip dispenser is used with a pill strip having a series of packets, each packet having a pill containing pocket so that the pills can be dispensed individually to a patient. The dispenser includes a housing defining a supply region within which a supply, typically a roll, of the pill strip is housed. The pill strip extends from the supply region, along a dispensing path within the housing and to a discharge position next to but external of the housing. The packets are dispensed, preferably one at a time, by a drive assembly within the housing.

The drive assembly is preferably a manually actuated drive assembly including a user operated plunger. The pill strip is captured between the pair of tooth drive wheels, which are preferably positioned along each lateral edge of the pill strip and a pair of overlying resilient rollers. The toothed drive wheels not only drive the pill strip in response to the actuation of the plunger, but also perforate the discharged pill strip package so that the contents of the packet can be easily accessed.

It is preferred that the pill strip includes a registration opening at a common location along one edge for each of the packets. A pin lock may be used to engage the registration opening in one packet when the packet immediately downstream is at the discharge position. This engagement causes the pin lock to also engage a gear in the drive train connecting the plunger to the toothed drive wheels thus halting movement of the drive wheels.

A pair of pill guides are used along the dispensing path to push the pills within the pockets away from the drive wheels. When the drive wheels are situated along the lateral edges of the pill strip, the pill guides push the pills towards the centers of the packets.

One the primary advantages of the invention is use of a drive system which both perforates or otherwise weakens the packet while driving the packet from the housing to a discharge position external of the housing.

The pin lock and registration opening not only accurately meter single packets from the housing but also help to prevent unauthorized or improper use of the assembly. That is, one must first disengage the pin lock before the drive wheels can be rotated by pushing on the plunger. However, the need to do so may not be immediately evident to one not familiar with the assembly.

Various types of safety features may be employed with the invention as well. For example, the plunger may be coupled to a combination lock so that only by entering the proper combination will the plunger operate.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
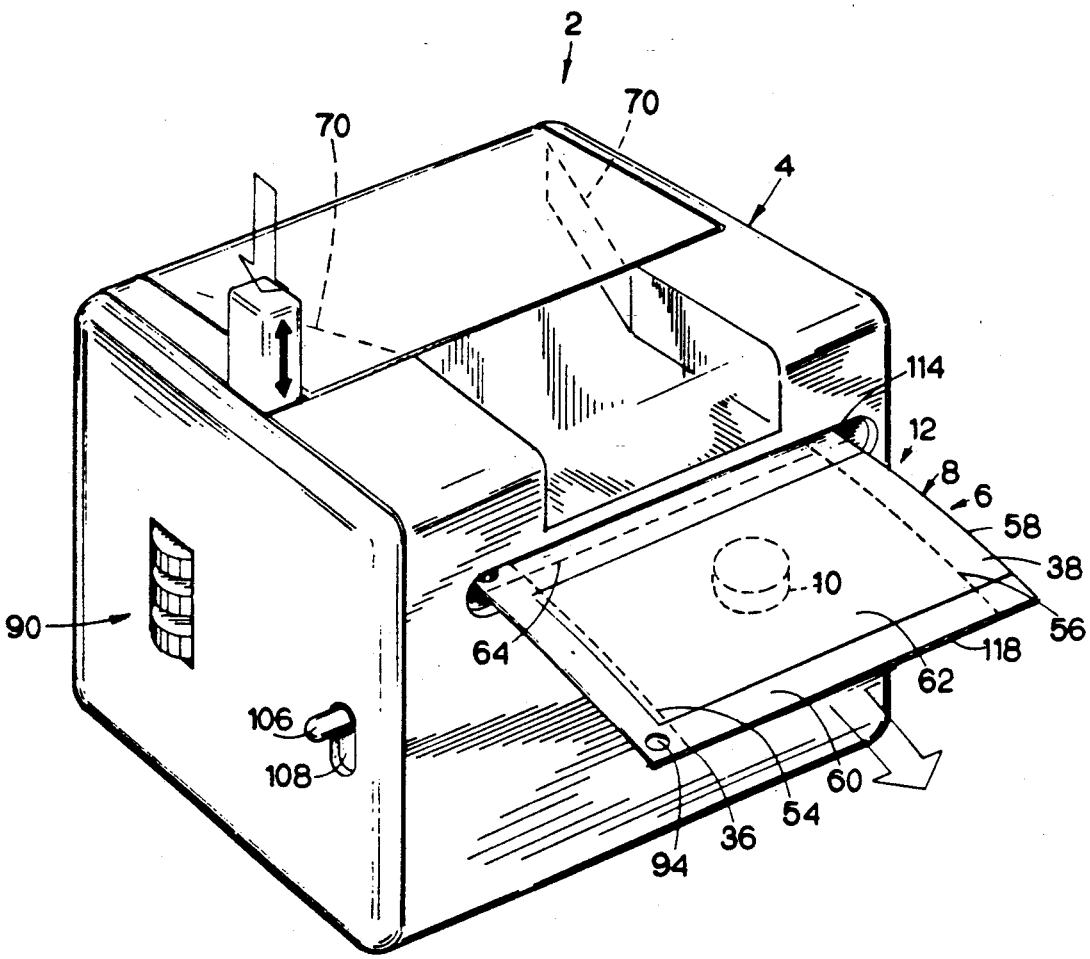
FIG. 1 is a front isometric view of a pill strip dispenser assembly made according to the invention.

FIG. 1 is an isometric view showing a pill strip dispenser assembly 2 including a pill strip dispenser 4 and a pill strip 6 housed therein. Pill strip 6 includes a series of packets 8 each containing medicine, typically in the form of a pill 10. One such packet 8 is shown at a discharge position 12 external of dispenser 4.

Figure 2:
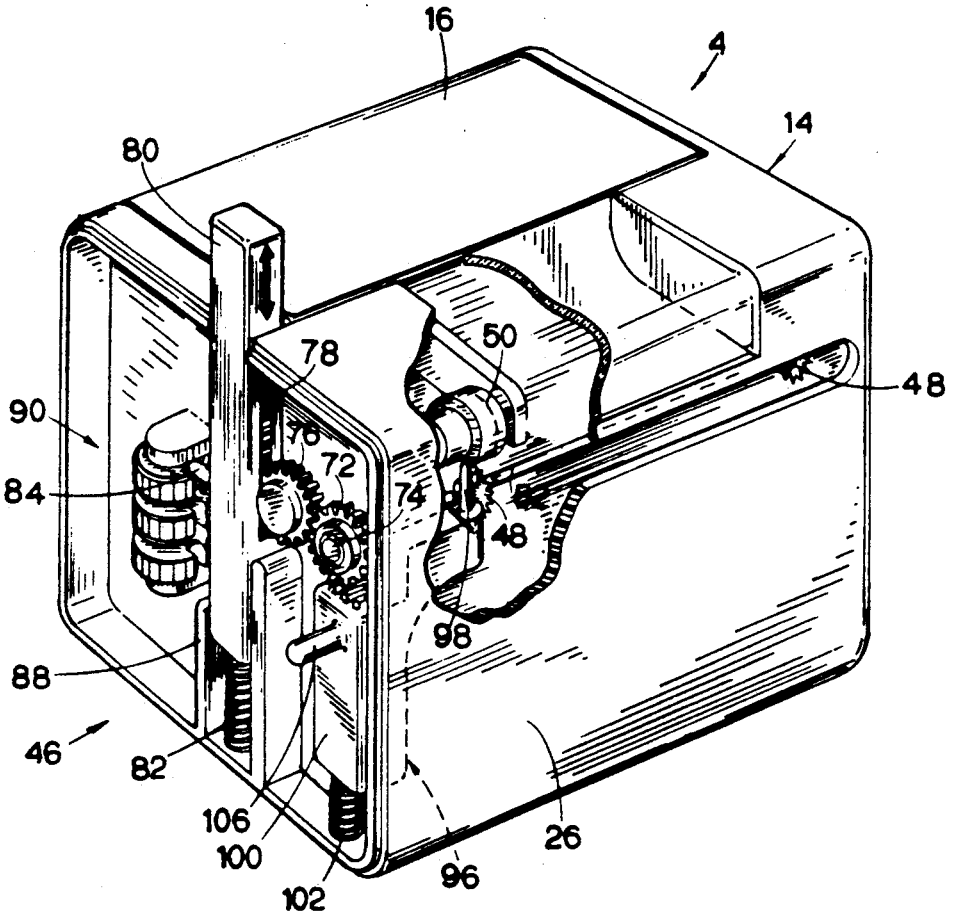
FIG. 2 is a front isometric view of the pill strip dispenser of FIG. 1 with portions broken away to illustrate various drive components.
Figure 3:
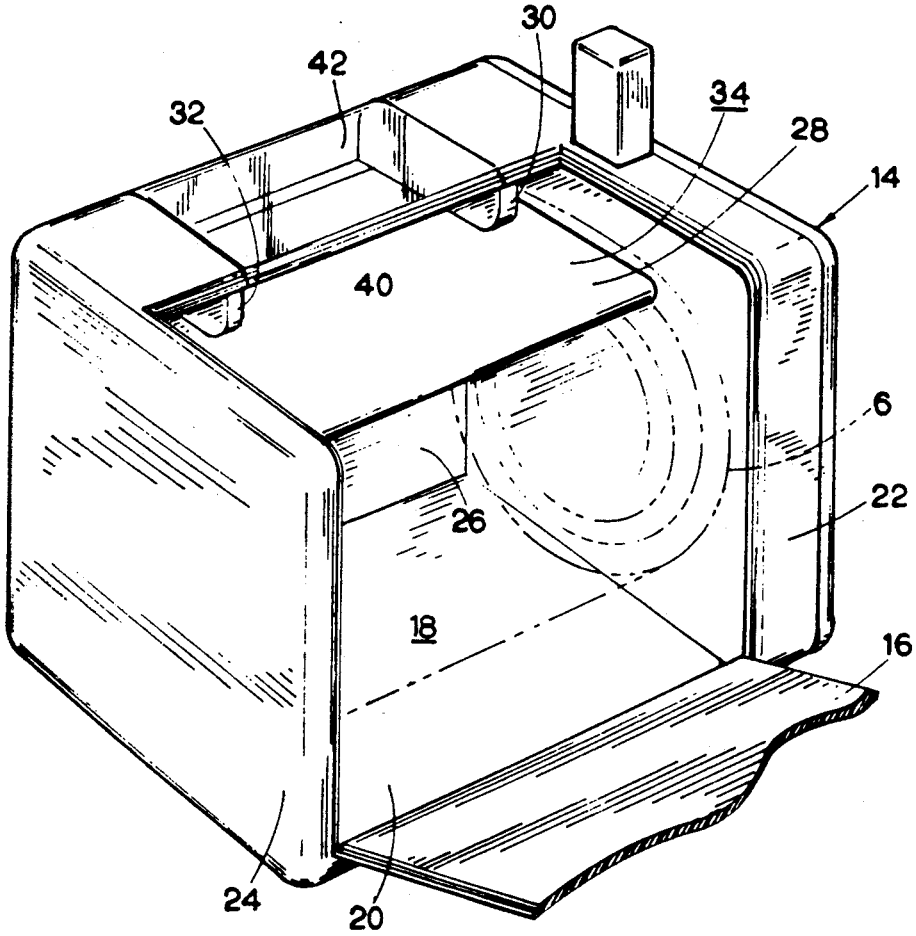
FIG. 3 is a rear isometric view of the pill dispenser of FIG. 2 with the door open showing the pill strip supply region.
Figure 6:
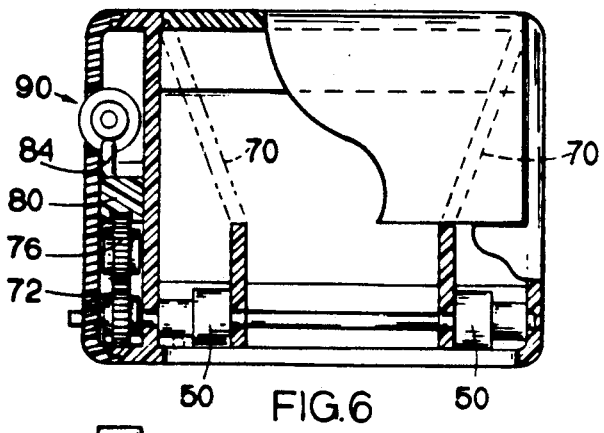
FIGS. 4, 5 and 6 are left side, front and top cross-sectional views of the pill strip dispenser of FIG. 2.

Pill strip dispenser 4 will be discussed in more detail with reference to FIG. 2. Dispenser 4 includes a rectangular housing 14, typically made of plastic. Housing includes the hinged door 16 which, as shown in FIG. 3, opens to expose a pill strip supply region 18. Region 18 is bounded generally by the bottom 20, side members 22, 24, front 26, and upper support of 28 of housing 14 as well as by door 16. Housing 14 also includes a pair of support guides 30, 32 positioned directly above the upper support surface 34 of upper support 28. Lateral edge regions 36, 38 of pill strip 6 pass between surface 34 and support guides 30, 32. The area overlying the forward portion 40 of upper support 28 is covered by a clear cover 42 which extends between support guides 30, 32. Clear cover 42 permits the user to view pill 10 and anything written on the upper surface of the packet 8 positioned under cover 42.

Turning our attention primarily to FIGS. 2 and 4–6, dispenser 4 is seen to include a drive assembly 46 mounted within housing 14. Drive assembly 46 includes a pair of toothed drive wheels 48 which are positioned beneath rubber idler rollers 50. Idler rollers 50 are mounted to support guides 30, 32. Drive wheels 48 and rollers 50 are positioned so that lateral edge regions 36, 38 pass therebetween. Drive wheels 48 are mounted to a common drive shaft 52 so that rotating drive shaft 52 causes toothed drive wheels 48 to engage pill strip 6 forcing packet 8 towards discharge position 12. By appropriately configuring the toothed circumference of drive wheels 48, drive wheels 48 are made to perforate pill strip 6 along drive lines 54, 56.

Each packet 8 includes a folded over edge 58 along lateral edge region 38 and a heat sealed region 60 along the other three sides to define a pocket 62 containing pill 10. Also, each packet 8 is separated by laterally extending separation lines 64, preweakened to aid separating packets 8 from one another. Drive line 56 intersects pocket 62 to aid removal of pill 10 as is discussed in more detail below.

Door 16 includes a pair of pill guides 70 which overlie support surface 34 of upper support 28. Pill guides 70 direct any pills 10 which may be adjacent edge regions 36, 38 towards the center of pocket 62 and thus away from support guides 30, 32, drive wheels 48 and idler rollers 50. This helps to keep assembly 2 from jamming during use.

Common drive shaft 52 is driven by a first drive gear 72 through a one-way clutch 74, such as one sold by Small Parts Co. of Miami, Fla. First drive gear 72 is driven by second drive gear 76 which itself is driven by a rack 78 formed in a plunger 80. Plunger 80 is biased upwardly by a spring 82. Movement of plunger 80 is limited by an arm 84, extending laterally therefrom, which engages upper and lower stops 86, 88.

To prevent unauthorized removal of packets 8, a safety lock 90 is used. Only when the right combination is used will arm 84 be permitted to move between stops 86, 88. Safety lock 90 is shown in a simplified form. A variety of safety interlocks may be used.

Pill strip dispenser assembly 2 also includes a registration opening 94 formed along lateral edge region 36 of each packet 8 at a chosen position relative to the forward or leading separation line 64 of each packet 8. Assembly 2 also includes a pin lock assembly 96 carried by housing 14. Assembly 96 includes a pin 98 extending upwardly from an L-base 100. L-base 100 is slideably mounted within housing 14 and is biased upwardly by a spring 102 towards first gear 72. L-base 100 includes teeth 104 at its upper end position to engage similar teeth in drive gear 72 through the urging of spring 102.

There are two ways to keep teeth 104 from engaging the teeth of first gear 72. The first is by manually pressing an arm 106 extending from L-base 100 through a slot 108 formed in housing 14. The other is through the positioning of lateral edge region 36 of pill strip 6 between pin 98 and a backing block 110, mounted to support guide 30, directly above pin 98.

Figure 4:
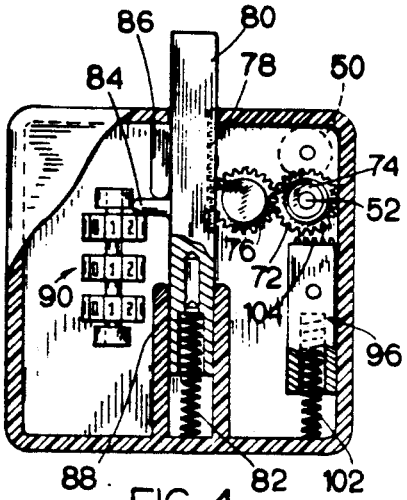
Figure 5:
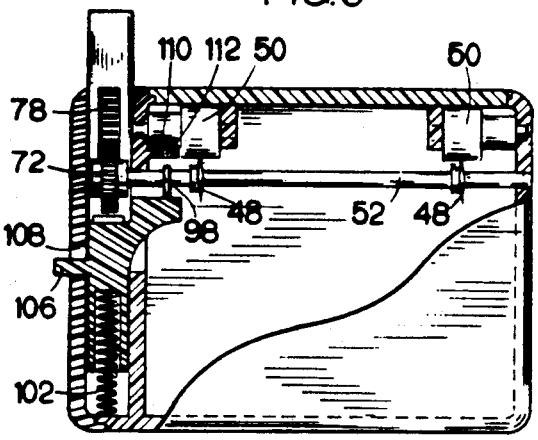

Pin 98 is, however, positioned to be aligned with registration opening 94 of one packet 8 when the adjacent, downstream packet 8 is properly positioned at discharge position 12. At this position pin 98 is urged upwardly through the bias of spring 102 so that pin 98 passes through opening 94 and into a shallow opening 112 in block 110. As the user sequentially presses and releases plunger 80, second and first drive gears 76, 72 rotate in an oscillating fashion, first one way and then the other. However, due to the existence of one way clutch 74, common drive shaft 52 rotates only in a single direction, that is clockwise as shown in FIG. 4. Once pin 98 engages opening 94, L-block 96 moves upwardly so that teeth 104 engage the teeth of gear 72 thus locking gears 72, 76 and plunger 80 in position. Only by manually pressing downwardly on arm 106 can the next packet be discharged from dispenser 4. After opening 94 is no longer aligned with pin 98, the user may release arm 106 and still advance pill strip 6 by pressing and releasing plunger 80.

Figure 7:
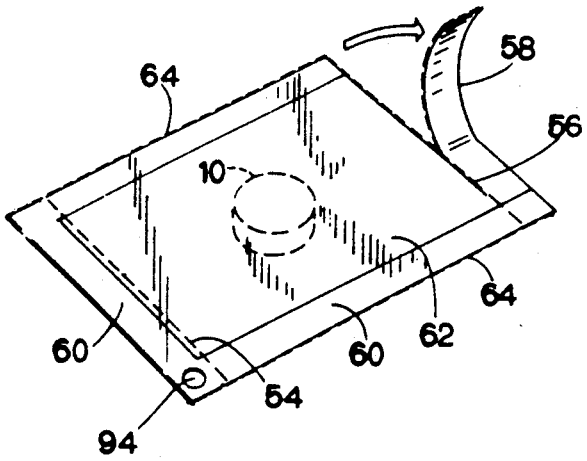
FIG. 7 shows a packet, having been dispensed from the assembly of FIG. 1, being operated along the weakened drive line.

Once a packet 8 is at discharge position 12, as shown in FIG. 1, the packet may be torn away from the rest of the pill strip 6. This is typically accomplished using the perforated or otherwise weakened separation line 64 which is aligned with a relatively sharp edge 114 at the end of the dispensing pad within dispenser 4. Pill 10 can be easily removed from packet 8 in a manner shown in FIG. 7 by tearing along weakened, in the preferred embodiment perforated, drive line 56. Thus, toothed drive wheels 48 will drive pill strip 6 through housing 4 but also perforate each packet 8 to aid removal of the medicine within pocket 62 of packet 8.

In use, dispenser 4 is first filled with a pill strip roll 6 by opening door 16 and placing the pill strip roll within region 18. The outer edge 118 of pill strip roll 6 is then passed over surface 34 and under support guides 30, 32 until edge 118 of the first packet 8 is generally aligned with edge 114. To do so, plunger 80 is pressed and released a number of times after drive wheels 48 have begun engaging pill strip 6. Door 16 is lowered so pill guides 70 capture pill strip 6 between guides 70 and surface 34. Once registration opening 94 is aligned with pin 98, the movement of pill strip 6 stops with the outer edge 118 of the outermost packet 8 generally aligned with edge 114 of housing 14. To provide security for assembly 2, safety lock 90 is manipulated so that actuation of plunger 80 is no longer possible. When it is desired to dispense a packet 8, security lock 90 is again manipulated to permit the actuation of plunger 80. Arm 106 is depressed briefly and plunger 80 is pressed and released until packet 8 reaches discharge position 12, at which time the registration opening 94 for the adjacent packet becomes aligned with pin 96 thus stopping movement of drive wheels 48. Packet 8 at position 12 is then torn or otherwise removed from the remainder of pill strip 6 and the contents of packet 8 is accessed by tearing along drive line 56.

In this application, the medicine in packet 8 is referred to as a pill 10. However, medicine may not be a single pill but could be one or more pills, tablet caplets, capsules or, in appropriate cases, granules or powder.

Various modifications and variations can be made to the disclosed embodiment without departing from the subject of the invention as defined in the following claims. For example, registration opening 94 could be a semicircular notch along one lateral edge instead of a circular hole. The invention is preferably a manually actuated invention for simplicity and lower cost. However, the invention could be practiced using an electrically powered drive as well. Automatic drives would be particularly useful when the operation of a dispenser assembly is to be digitally controlled. Various types of security devices could also be used, such as time locks which would allow operation of the drive only during predetermined times and only to dispense a predetermined number of packets 8.

What is claimed is:

1. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region and a dispensing path along which the pill strip moves from the supply region to a discharge position; and a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet.

2. The assembly of claim 1 wherein the pill strip package includes weakened areas along the laterally extending separation lines to aid separation of one said packet from an adjacent said packet.

3. The assembly of claim 1 wherein the discharge position is external of the housing.

4. The assembly of claim 1 further comprising control means for dispensing the pill strip from the pill strip dispenser one packet at a time.

5. The assembly of claim 1 wherein the medicine is in pill form.

6. The assembly of claim 1 wherein the packets have sealed regions along one said longitudinal edge and along both said separation lines.

7. The assembly of claim 1 wherein the drive element includes a rotatable wheel having means for perforating the pill strip package thereby weakening the pill strip package along the drive line.

8. A pill strip dispenser assembly comprising:

a pill strip including a pill strip package having longitudinal edges and defining a plurality of longitudinally arranged packets, each packet including a pocket with medicine therein, the packets separated by pre-weakened laterally extending separation lines; and a pill strip dispenser including:

a housing defining a supply region and a dispensing path along which the pill strip moves from the supply region to a discharge position external of the housing;

a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet;

directing means for directing the medicine in each said pocket away from the drive line so as not to interfere with the drive element; and control means for dispensing the pill strip from the pill strip dispenser a chosen number of packets at a time.

9. The assembly of claim 8 wherein the drive element includes a rotatable wheel having means for perforating the pill strip package thereby weakening the pill strip package along the drive line.

10. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region and a dispensing path along which the pill strip moves from the supply region to a discharge position; and a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet; and control means for dispensing the pill strip from the pill strip dispenser one packet at a time, the control means including a registration opening, formed in each packet, and pin means, coupled to the drive assembly, for engagement with successive ones of the registration openings when aligned therewith.

11. The assembly of claim 10 wherein the control means includes means for halting movement of the drive element when the pin means engages one of the registration openings.

12. The assembly of claim 10 wherein the registration openings include a hole formed in each of the packets at a chosen location relative to at least one of the separation lines.

13. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region and a dispensing path along which the pill strip moves from the supply region to a discharge position; and a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet; and the housing including directing means for directing the medicine in each said pocket away from the drive line so as not to interfere with the drive element.

14. The assembly of claim 13 wherein the housing includes a support surface along the dispensing path between the supply region and the drive element, and wherein the directing means include a pill guide overlying the support surface and in contact with the pill strip.

15. The assembly of claim 14 wherein the pill guide is arranged to direct the medicine towards a central region of each of said pockets.

16. The assembly of claim 15 wherein the directing means includes at least two of said pill guides.

17. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region and a dispensing path along which the pill strip moves from the supply region to a discharge position;

a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet; and the housing including a tear edge at the discharge position to aid separation of a newly discharged packet from a remainder of the pill strip.

18. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region, configured to hold said pill strip in the form of a roll, a dispensing path along which the pill strip moves from the supply region to a discharge position; and a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet.

19. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region and a dispensing path along which the pill strip moves from the supply region to a discharge position; and a manually operated drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet.

20. The assembly of claim 19 wherein the drive assembly includes a user-actuated plunger having a portion extending external of the housing.

21. The assembly of claim 20 wherein the drive assembly includes drive train including a rack formed on the plunger.

22. A pill strip dispenser assembly comprising:

a pill strip including a pill strip package having longitudinal edges and defining a plurality of longitudinally arranged packets, each packet including a pocket with medicine therein, the packets separated by laterally extending separation lines; and a pill strip dispenser including:

a housing defining a supply region and a dispensing path along which the pill strip moves from the supply region to a discharge position; and a drive assembly, mounted at least partially within the housing, including a drive train having a drive shaft and a rotatable drive element mounted to the drive shaft, the rotatable drive element positioned along the dispensing path to engage the pill strip along a drive line and force the pill strip from the supply region, along the dispensing path and to the discharge position, the drive line intersecting at least a portion of each of the pockets, the drive element weakens the pill strip package along the drive line to form a tear line to aid access to the medicine within the packet.

23. The assembly of claim 22 wherein the drive train includes a gear.

24. The assembly of claim 22 further comprising control means for dispensing the pill strip from the pill strip dispenser one packet at a time, the control means including a registration opening formed in each packet at a fixed location relative to at least one of the separation lines.

25. The assembly of claim 24 wherein the control means further comprises:

a pin lock movable between first and second positions;

means for biasing the pin lock towards the first position;

the pin lock including a drive train engaging member which engages the drive train when the pin lock is in the first position, but not when in the second position, so to halt movement of the drive train when in the first position; and the pin engaging the pill strip package when in the second position with the pill strip package preventing the pin biasing means from moving the pin lock to the first position.

26. The assembly of claim 24 wherein the control means further comprises:

means for engaging a registration opening of one said packet when another said packet is at the discharge position; and means for preventing movement of the rotatable drive element when the engaging means engages said registration opening.

27. A pill strip dispenser assembly comprising:

a pill strip including a pill strip package having longitudinal edges and defining a plurality of longitudinally arranged packets, each packet including a pocket with medicine therein, the packets separated by pre-weakened laterally extending separation lines; and a pill strip dispenser including:

a housing defining a supply region and a dispensing path along which the pill strip moves from the supply region to a discharge position external of the housing;

a drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet;

directing means for directing the medicine in each said pocket away from the drive line so as not to interfere with the drive element; and control means for dispensing the pill strip from the pill strip dispenser a chosen number of packets at a time, the control means including a registration opening formed in each packet and pin means, coupled to the drive assembly, for engagement with successive ones of the registration openings when aligned therewith.

28. The assembly of claim 27 wherein the control means includes means for halting movement of the drive element when the pin engages one of the registration openings.

29. A pill strip dispenser assembly comprising:

a pill strip including a pill strip package having longitudinal edges and defining a plurality of longitudinally arranged packets, each packet including a pocket with medicine therein, the packets separated by pre-weakened laterally extending separation lines; and a pill strip dispenser including:

a housing defining a supply region and a dispensing path along which the pill strip moves from the supply region to a discharge position external of the housing;

a manually operated drive assembly, mounted at least partially within the housing, including a drive element along the dispensing path which engages the pill strip along a drive line and forces the pill strip from the supply region, along the dispensing path and to the discharge position, the drive line intersecting at least a portion of each of the pockets, the drive element weakens the pill strip package along the drive line to form a tear line to aid access to the medicine within the packet;

directing means for directing the medicine in each said pocket away from the drive line so as not to interfere with the drive element; and control means for dispensing the pill strip from the pill strip dispenser a chosen number of packets at a time.

30. The assembly of claim 29 wherein the drive assembly includes a user-actuated plunger having a portion extending external of the housing.

* * * * *